US007789808B2

(12) United States Patent
Lee

(10) Patent No.: US 7,789,808 B2
(45) Date of Patent: Sep. 7, 2010

(54) EXERCISING DEVICE

(76) Inventor: Sunny Lee, No. 48-20, Ching-Chai Lane, Nan-Pu Li, Tsao-Tun Chen, Nan-Tou Hsien (TW)

( * ) Notice: Subject to any disclaimer, the term of this patent is extended or adjusted under 35 U.S.C. 154(b) by 31 days.

(21) Appl. No.: 12/290,907

(22) Filed: Nov. 4, 2008

(65) Prior Publication Data

US 2010/0029445 A1 Feb. 4, 2010

(30) Foreign Application Priority Data

Jul. 30, 2008 (TW) ..... 97213485 U

(51) Int. Cl.
*A63B 22/12* (2006.01)

(52) U.S. Cl. ..... 482/62; 482/57; 482/63

(58) Field of Classification Search ..... 482/57, 482/62–65, 72–73; 601/36
See application file for complete search history.

(56) References Cited

U.S. PATENT DOCUMENTS 2,107,447 A * 2/1938 Marlowe ..... 482/63
3,888,136 A * 6/1975 Lapeyre ..... 74/594.1
4,019,230 A * 4/1977 Pollard ..... 280/214
4,519,604 A * 5/1985 Arzounian ..... 482/57
4,757,988 A * 7/1988 Szymski ..... 482/59
5,035,417 A * 7/1991 Ross ..... 482/62
5,330,402 A * 7/1994 Johnson ..... 482/62
5,906,563 A * 5/1999 Pittari ..... 482/62
6,589,139 B1 * 7/2003 Butterworth ..... 482/57
6,682,462 B1 * 1/2004 Lee ..... 482/72
7,226,394 B2 * 6/2007 Johnson ..... 482/57
7,594,879 B2 * 9/2009 Johnson ..... 482/57
2006/0122039 A1 * 6/2006 Lee et al. ..... 482/57

* cited by examiner

*Primary Examiner*—Fenn C Mathew
*Assistant Examiner*—Andrew M Tecco
(74) *Attorney, Agent, or Firm*—Townsend and Townsend and Crew, LLP

(57) ABSTRACT

An exercising device includes a front frame, a resistance flywheel mounted rotatably on the front frame, a drive wheel connected drivingly to the resistance flywheel, a crank wheel, a shaft connected rotatably to the front frame and extending centrally through the drive wheel and eccentrically through the crank wheel for co-rotating the drive wheel and the crank wheel, two pedal units connected respectively to left and right ends of the shaft, a handle assembly mounted on top of the front frame, a rear frame extending rearwardly from the front frame, a slide seat mounted slidably on the rear frame, a chair supported on the slide seat, and a link mechanism connected to and disposed between the slide seat and the crank wheel. The link mechanism is driven by the crank wheels as to move forward and rearward the slide seat.

10 Claims, 15 Drawing Sheets

EXERCISING DEVICE

CROSS-REFERENCES TO RELATED APPLICATIONS

This application claims priority to Taiwanese Application No. 097213485, filed Jul. 30, 2008, the disclosure of which is herein incorporated by reference.

BACKGROUND OF THE INVENTION

1. Field of the Invention

This invention relates to an exercising device, more particularly to an exercising device that can be used to exercise a user's upper body, lower body, and abdomen, perform stretching, and to enhance coordination among different parts of the body.

2. Description of the Related Art

Referring to FIG. 1, a conventional exercising device 10 is shown to include a frame 14, a pedal assembly 11 connected to a front side of the frame 14 and having left and right pedal members 111 (only one is visible), a handle assembly 12 disposed above the pedal assembly 11 and having left and right handgrips 121, and a chair assembly 13 connected to a rear side of the frame 14. In use, the user's feet extend to the respective pedal members 111 to perform a cycling exercise, and the user's hands extend to grasp the respective handgrips 121 to perform a hand-cycling exercise, thereby achieving simultaneous exercise of the user's arms and legs, but not other parts of the user's body. Hence, use of the conventional exercising device 10 is limited.

Referring to FIG. 2, another conventional exercising device 20 is shown to include a frame 21, a wheel assembly 22 disposed on a front side of the frame 21, and a chair assembly 23 disposed on a rear side of the frame 21. The frame 21 is provided with a horizontal slide rail 211, a support rod 212 connected to the front side of the frame 21, and two footrest plates 213 connected respectively to two opposite sides of the support rod 212. The chair assembly 23 has a chair 232 provided with a slide seat 231 on a bottom portion thereof, and a pull rope 233 having one end connected with a handgrip 234, and another end extending downwardly from a top side of the support rod 212 so as to connect with the slide seat 231. The slide seat 231 is engaged to the slide rail 211, so that the chair 232 is slidable forwardly and rearwardly along the slide rail 211. The handgrip 234 is disposed on a front side of the chair assembly 23 to facilitate grasping by the user's hands. To use the conventional exercising device 20, after the user is seated on the chair 232, the user's feet are placed on the respective footrest plates 213, and the user begins the exercise by pulling the handgrip 234 so as to slide forwardly and rearwardly the chair 232. Stretching of the user's body and an upper body workout are realized through such exercise. However, the conventional exercising device 20 does not provide exercise to the user's legs, so that use of the conventional exercising device 20 is also limited.

SUMMARY OF THE INVENTION

Therefore, the object of the present invention is to provide an exercising device that is capable of overcoming the aforementioned drawbacks of the prior art.

According to one aspect of this invention, an exercising device comprises a front frame, a resistance flywheel mounted rotatably on the front frame, a drive wheel connected drivingly to the resistance flywheel, a crank wheel, a shaft connected rotatably to the front frame and extending centrally through the drive wheel and eccentrically through the crank wheel for co-rotating the drive wheel and the crank wheel, two pedal units connected respectively to left and right ends of the shaft, a handle assembly mounted on top of the front frame, a rear frame extending rearwardly from the front frame, a slide seat mounted slidably on the rear frame, a chair supported on the slide seat, and a link mechanism connected to and disposed between the slide seat and the crank wheel. The link mechanism is driven by the crank wheel so as to move forward and rearward the slide seat.

According to another aspect of this invention, an exercising device comprises a front frame, a resistance flywheel mounted rotatably on the front frame, a drive wheel connected drivingly to the resistance flywheel and having a shaft, two pedal units connected respectively to left and right ends of the shaft, a crank wheel co-rotatable with the drive wheel about an axis of rotation, a handle assembly mounted on top of the front frame, a rear frame extending rearwardly from the front frame, a slide seat mounted slidably on the rear frame, and a link mechanism connected to and disposed between the slide seat and the crank wheel. The handle assembly includes a support rod extending upwardly from the front frame, a spindle connected to and projecting from left and right sides of the support rod, and two handgrips connected respectively to two opposite ends of the spindle. At least one of the handgrips is releasably connected to the spindle for adjusting an angular position of said one of the handgrips relative to the spindle. The handle assembly further includes at least one handgrip positioning unit that connects adjustably and releasably said one of the handgrips to the spindle. The link mechanism is driven by the crank wheel so as to move forward and rearward the slide seat.

According to still another aspect of this invention, an exercising device comprises a frame, a resistance flywheel mounted rotatably on the frame, a drive wheel connected drivingly to the resistance flywheel, a crank wheel co-rotatable with the drive wheel about an axis of rotation, a shaft connected rotatably to the frame and journalled to the drive wheel, and two pedal units connected respectively to left and right ends of the shaft. Each of the pedal units has a pedal crank journalled to the shaft, and a pedal plate fixed to an end of the pedal crank. At least one of the pedal cranks of the pedal units is rotatable relative to the shaft to adjust in angular position relative to the shaft. At least one of the pedal units further has a tightening member to prevent said one of the pedal cranks from rotation relative to the shaft.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
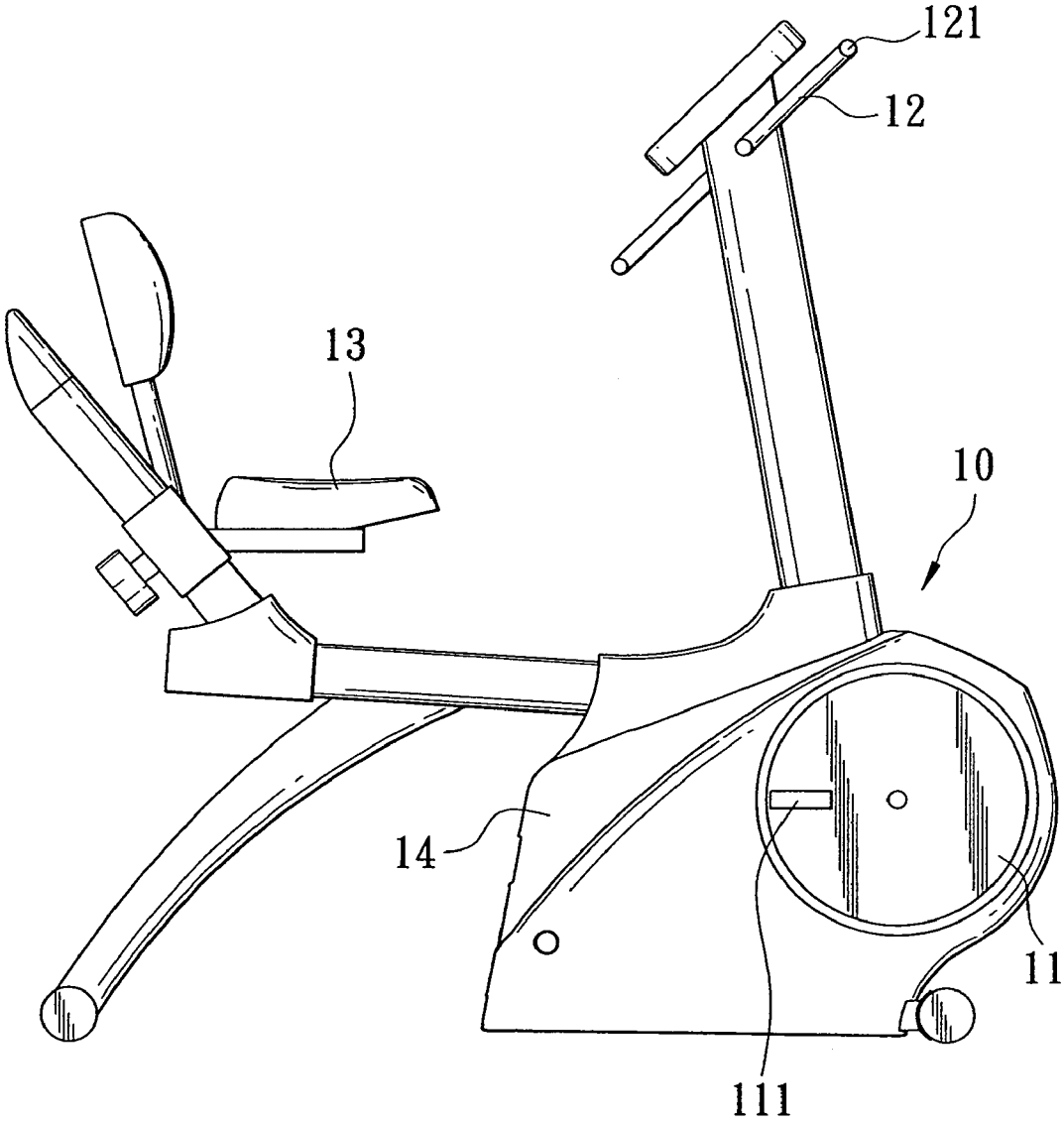
FIG. 1 PRIOR ART
FIG. 1 is a schematic side view of a conventional exercising device.
Figure 2:
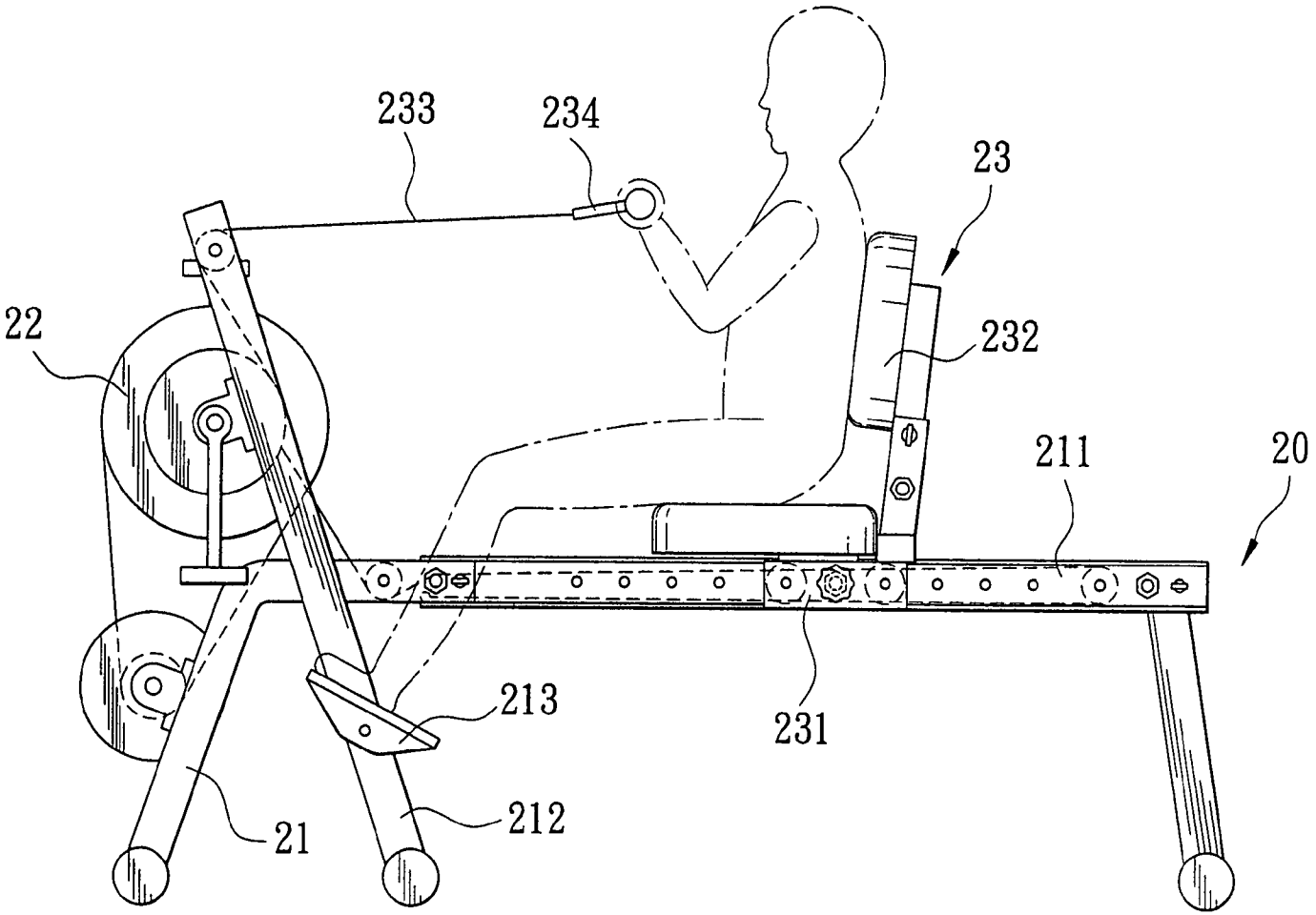
FIG. 2 PRIOR ART
FIG. 2 is a schematic side view of another conventional exercising device.

Referring to FIGS. 3 to 10, an exercising device according to the preferred embodiment of the present invention is shown to comprise a frame, a resistance flywheel 32, a drive wheel 33, a crank wheel 36, two pedal units 34, 34', a handle assembly 40, a chair assembly 50, and a link mechanism 54.

The frame includes a front frame 31, and a rear frame 51 extending rearwardly from the front frame 31. The rear frame 51 includes a hollow horizontal support bar 511, and a support leg 510 connected to a rear end portion of the support bar 511. The support bar 511 has two slide rails 512 provided respectively on two opposite lateral sides thereof. Each of the slide rails 512 is formed with an elongated slot 513 communicating spatially with an inner portion of the support bar 511.

The resistance flywheel 32 is journalled to a shaft 310 provided on a rear side of the front frame 31.

The drive wheel 33 is journalled to a shaft 331 provided on a front side of the front frame 31, and is connected drivingly to the resistance flywheel 32.

The crank wheel 36 includes a disc 361, a ring 362 sleeved around the disc 361, and a cover plate 363 screwed to one side of the disc 361 so as to retain the ring 362 on the disc 361. The disc 361 has an eccentric hole 3611, a predetermined width, and an annular flange 3612 opposite to the cover plate 363. The ring 362 is rotatable relative to the disc 361, and is disposed between the cover plate 363 and the flange 3612.

A belt pulley 35 is connected coaxially to the drive wheel 33, and is disposed between the drive wheel 33 and the crank wheel 36. During use, the user overcomes the resistance of the resistance wheel 32 by pedaling the two pedal units 34, 34' so as to rotate the drive wheel 33. The drive wheel 33, in turn, rotates therealong the belt pulley 35 and the crank wheel 36. The disc 361 at this time undergoes an eccentric rotation, and the ring 362 moves relative to the disc 361. It is to be noted that instead of the crank wheel 36, other mechanisms may be used.

The shaft 331 is connected rotatably to the front frame 31, and extends centrally through the drive wheel 33 and eccentrically through the disc 361 of the crank wheel 36 for co-rotating the drive wheel 33 and the disc 361.

The pedal units 34, 34' are connected respectively to left and right ends of the shaft 331. Each of the pedal units 34, 34' has a pedal crank 341, 341' journalled to the shaft 331, and a pedal plate 342, 342' fixed to an end of the pedal crank 341, 341' and adapted to be pedaled by a user's foot. At least one of the pedal units 34, 34' is rotatable relative to the shaft 331. In this embodiment, the pedal unit 34 is rotatable relative to the shaft 331 to adjust in angular position relative to the shaft 331. The pedal unit 34 further has a pedal positioning plate 343 fixed around the shaft 331 adjacent the pedal crank 341 thereof, and a tightening member 344 connected to the shaft 331 adjacent the pedal crank 341 and oppositely of the pedal positioning plate 343 so as to prevent the pedal crank 341 from rotation relative to the shaft 331. The pedal positioning plate 343 is engageable with the pedal crank 341 to restrict rotation thereof when the tightening member 344 is tightened so as to press the pedal crank 341 against the pedal positioning plate 343. The pedal crank 341 and the pedal positioning plate 343 are provided with interengageable protrusions and recesses therebetween. Preferably, the pedal crank 341 is formed with the recesses 3411, and the pedal positioning plate 343 is formed with the protrusions 3431.

Figure 5:
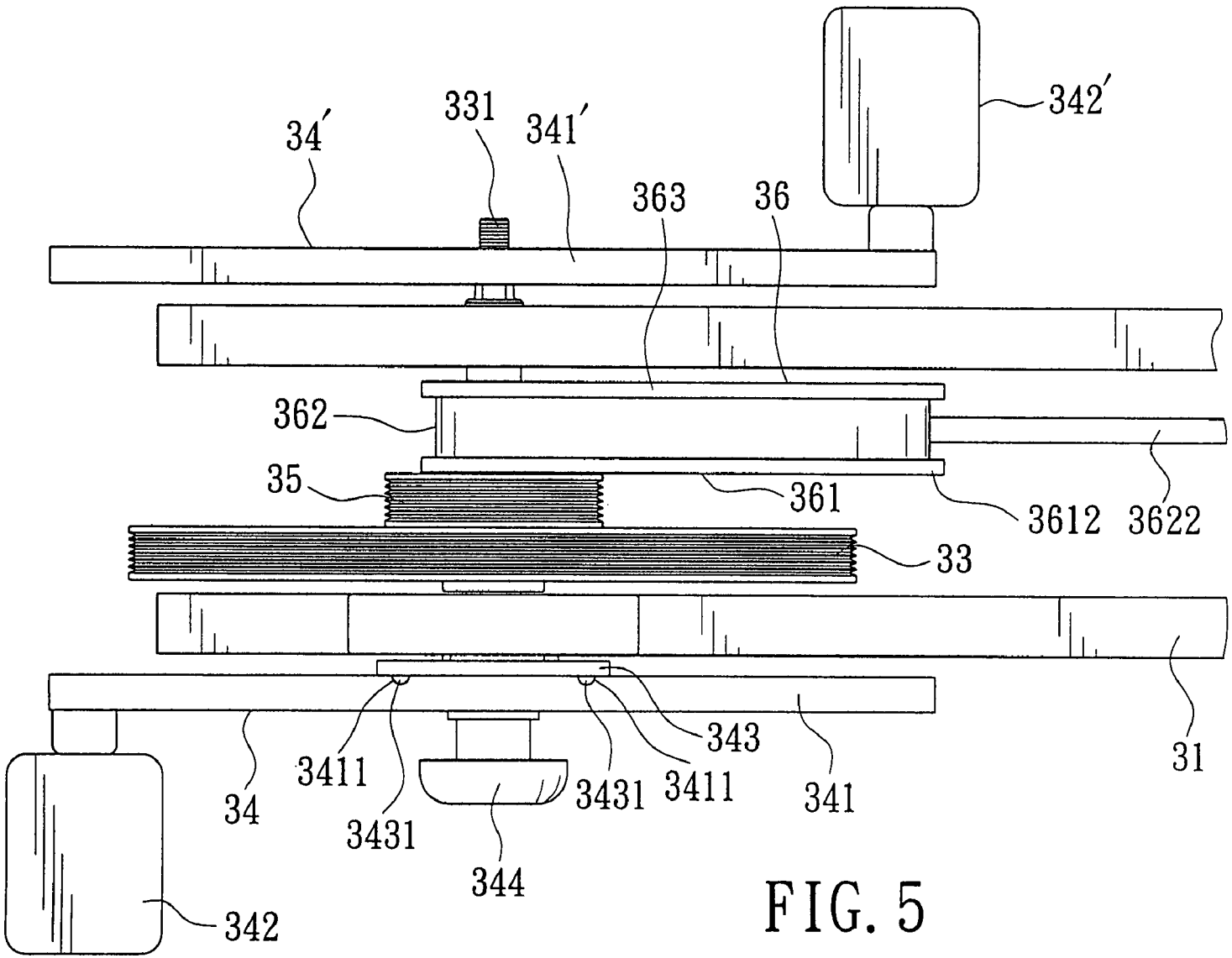
FIG. 5 is a fragmentary schematic view of the preferred embodiment, illustrating connections among two pedal units, a shaft, a front frame, a drive wheel, and a crank wheel.
Figure 6:
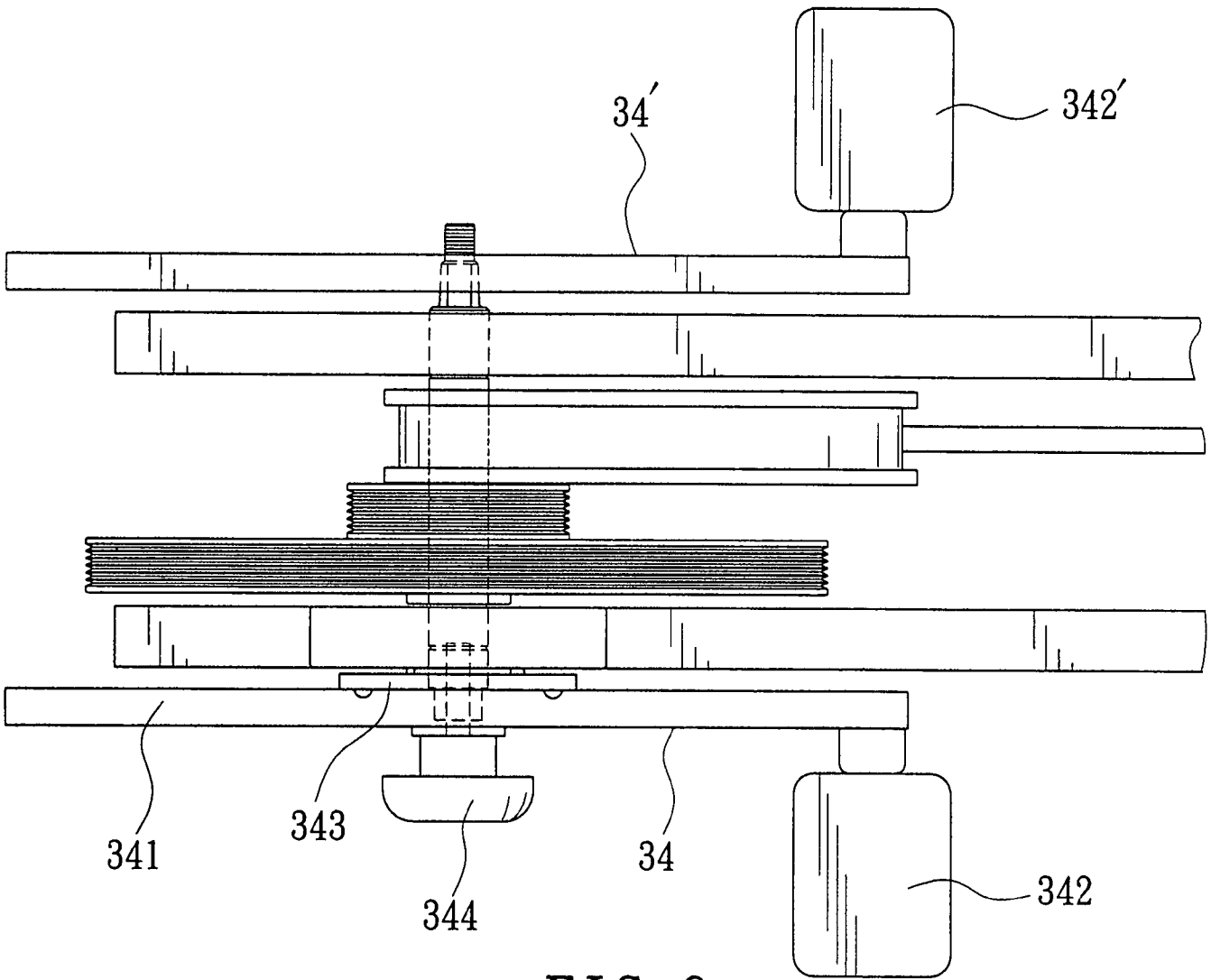
FIG. 6 is a view similar to FIG. 5, but illustrating one of the pedal units being adjusted to be at the same angular position as the other one of the pedal units.
Figure 7:
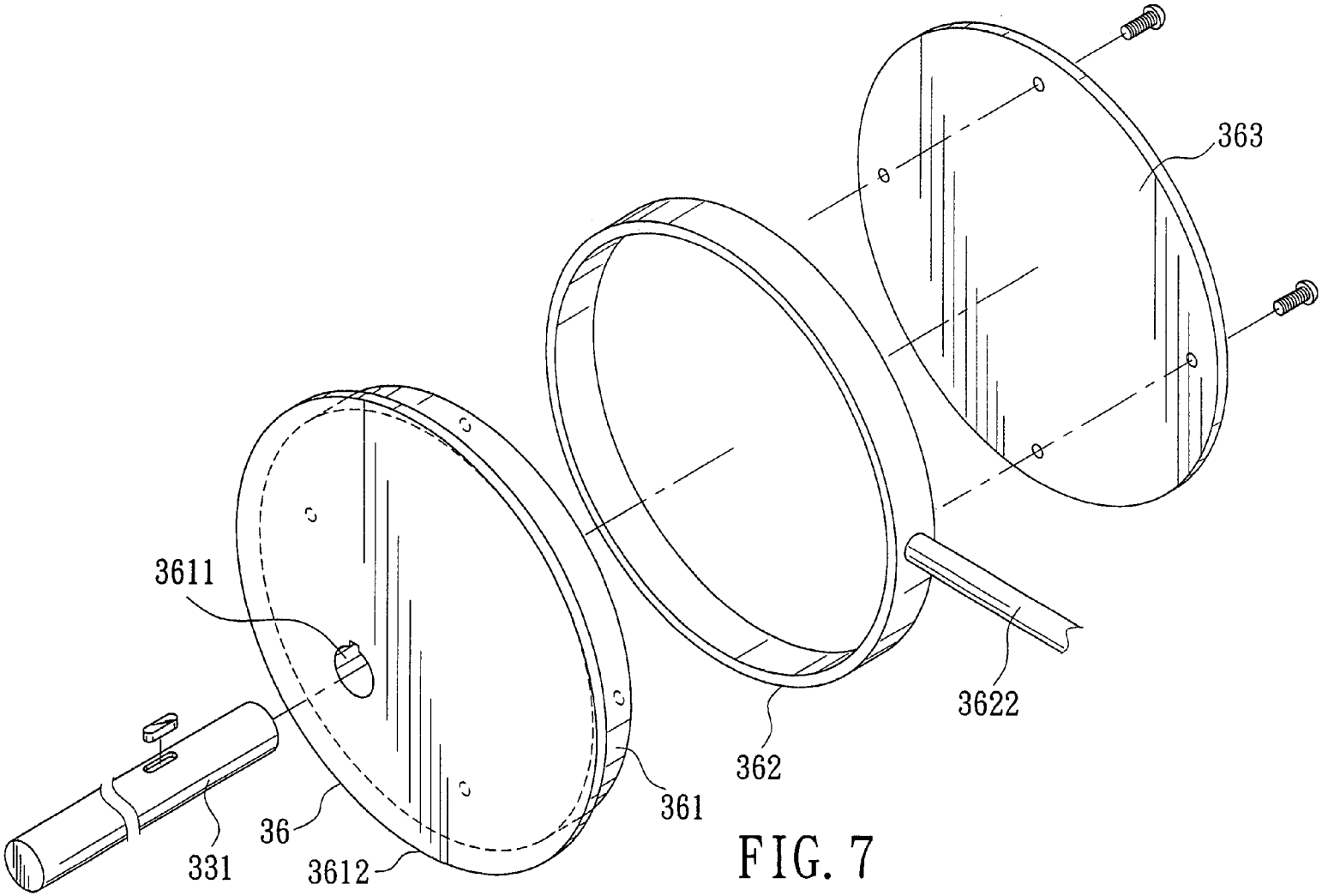
FIG. 7 is an exploded perspective view of a crank wheel of the preferred embodiment.
Figure 8:
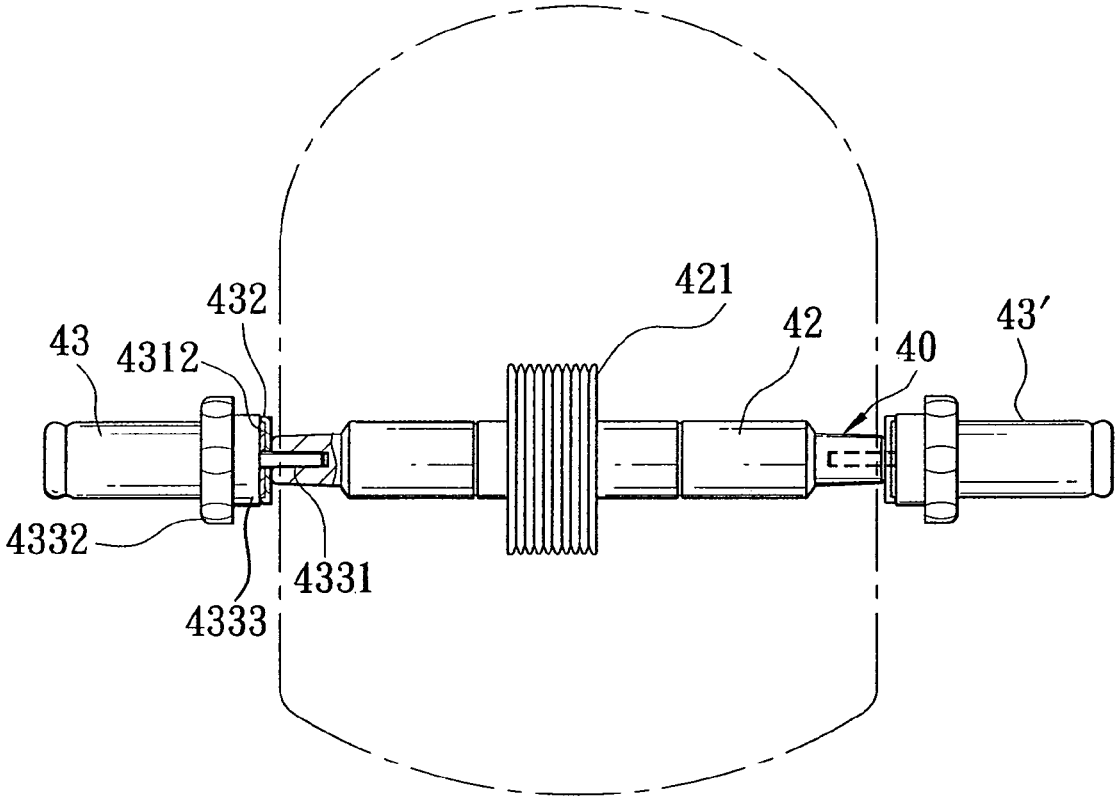
FIG. 8 is an enlarged schematic view of a handle assembly of the preferred embodiment.

The pedal crank 341 of the pedal unit 34 can selectively adjust its angular position relative to the shaft 331, so that the pedal plate 342 can be spaced apart from the pedal plate 342' at an angular distance of 180°, as shown in FIG. 5, or can be at the same angular position with the pedal plate 342', as shown in FIG. 6.

With reference to FIGS. 3, 5, 8, and 9, the handle assembly 40 is mounted on top of the front frame 31, and includes a support rod 41 extending upwardly from the front frame 31, a spindle 42 connected to and projecting from left and right sides of the support rod 41, and two handgrips 43, 43' connected respectively to two opposite ends of the spindle 42. The spindle 42 is provided with a belt pulley 421 at a central portion thereof. The belt pulley 421 and the belt pulley 35 are interconnected through a belt (not shown), so that when the drive wheel 33 rotates, the spindle 42 can be moved to rotate therealong. At least one of the handgrips 43, 43' may be releasably connected to the spindle 42. In this embodiment, each of the handgrips 43, 43' is releasably connected to the spindle 42 for adjusting an angular position thereof relative to the spindle 42. A handgrip positioning unit is provided on each handgrip 43, 43' so as to connect adjustably and releasably a respective one of the handgrips 43, 43' to the spindle 42. The handgrip positioning unit includes a handgrip positioning plate 431, a limit member 432, and a tightening member 433.

The handgrip positioning plate 431 has a proximal end portion 4312 substantially perpendicular and adjacent to the spindle 42, and a distal end portion 4313 connected to the respective handgrip 43, 43' and radially offset from the spindle 42. The limit member 432 is disposed between the spindle 42 and the proximal end portion 4312 to limit rotation of the proximal end portion 4312. The limit member 432 has a substantially U-shaped plate defining a channel 4321 that receives the proximal end portion 4312. The tightening member 433 is connected to the spindle 42 to press the proximal end portion 4312 against the limit member 432 when the tightening member 433 is tightened. The tightening member 433 has a threaded portion 4331 extending through the proximal end portion 4312 and the limit member 432 and threaded into the spindle 42, a knob 4332, and a press part 4333 connected between the threaded portion 4331 and the knob 4332 to press the proximal end portion 4312 against the limit member 432 and the spindle 42 when the tightening member 433 is tightened.

Figure 3:
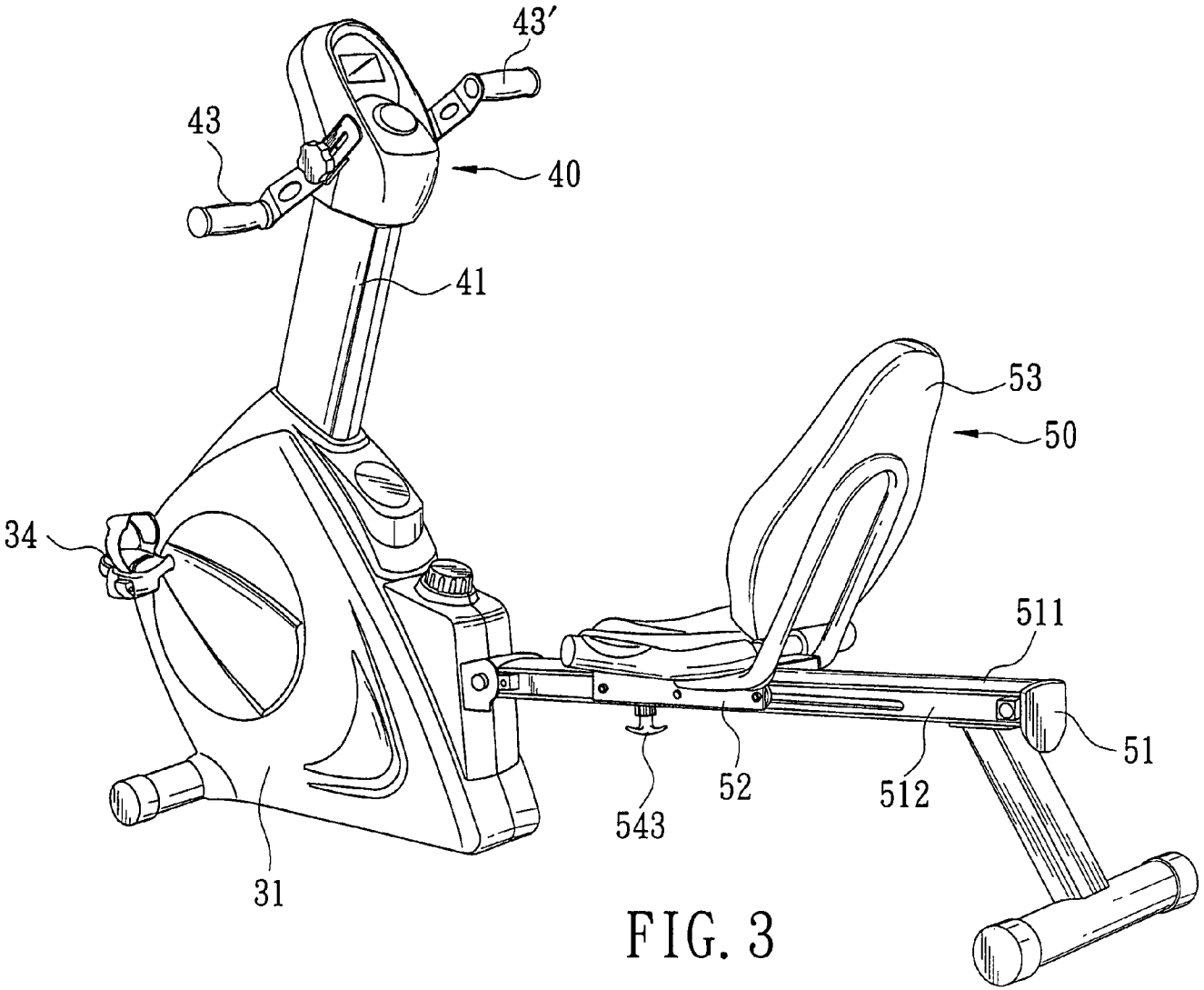
FIG. 3 is a perspective view of an exercising device according to the preferred embodiment of the present invention.
Figure 9:
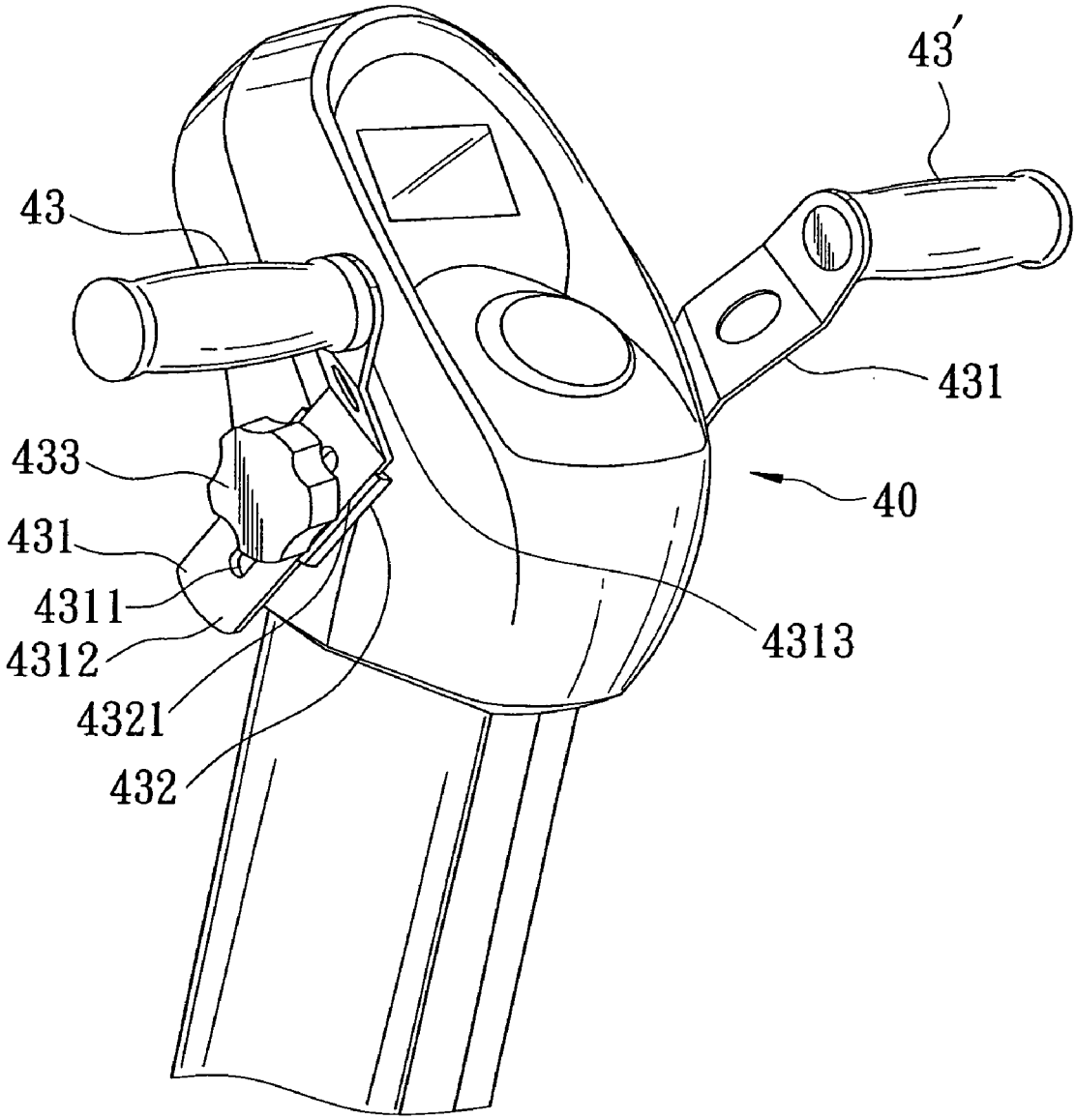
FIG. 9 is an enlarged perspective view of the handle assembly of the preferred embodiment.

In this embodiment, the proximal end portion 4312 is formed with an elongated slot 4311 having a predetermined length for extension of the threaded portion 4331 of the tightening member 433 therethrough. A desired radial distance of each handgrip 43, 43' relative to the spindle 42 may be adjusted by loosening engagement of the tightening member 433 with the spindle 42 so as to permit radial movement of the proximal end portion 4312 relative to the spindle 42. After the desired radial distance of each handgrip 43, 43' is reached, the tightening member 433 is tightened. Further, when the tightening member 433 is loosened from the spindle 42, the proximal end portion 4312 of one of the handgrips 43, 43' may be rotated so as to position the handgrips 43, 43' at the same angular position, as shown in FIG. 9, or spaced apart from each other at an angular distance of 180°, as shown in FIG. 3.

Figure 4:
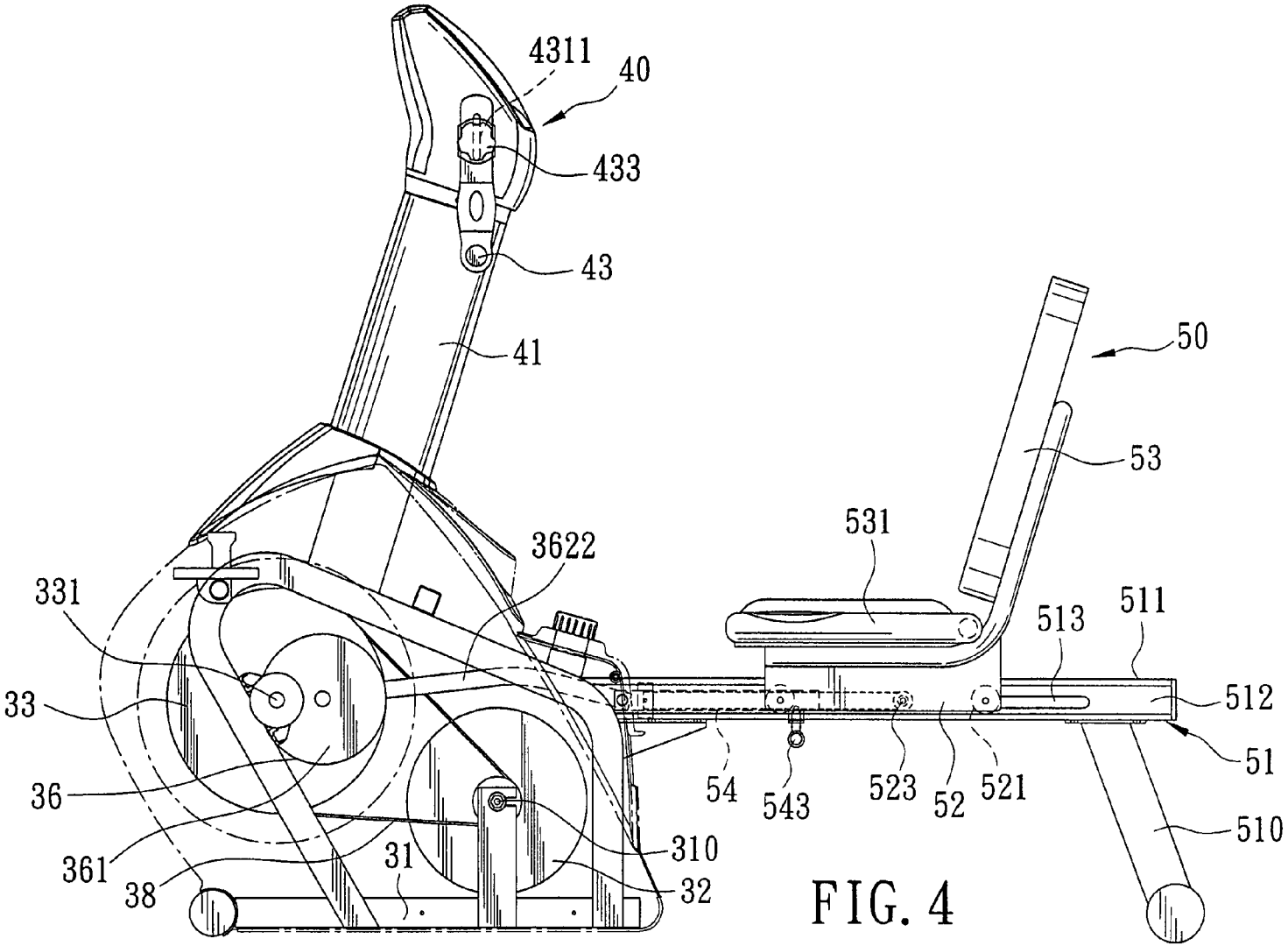
FIG. 4 is a schematic side view of the preferred embodiment.
Figure 10:
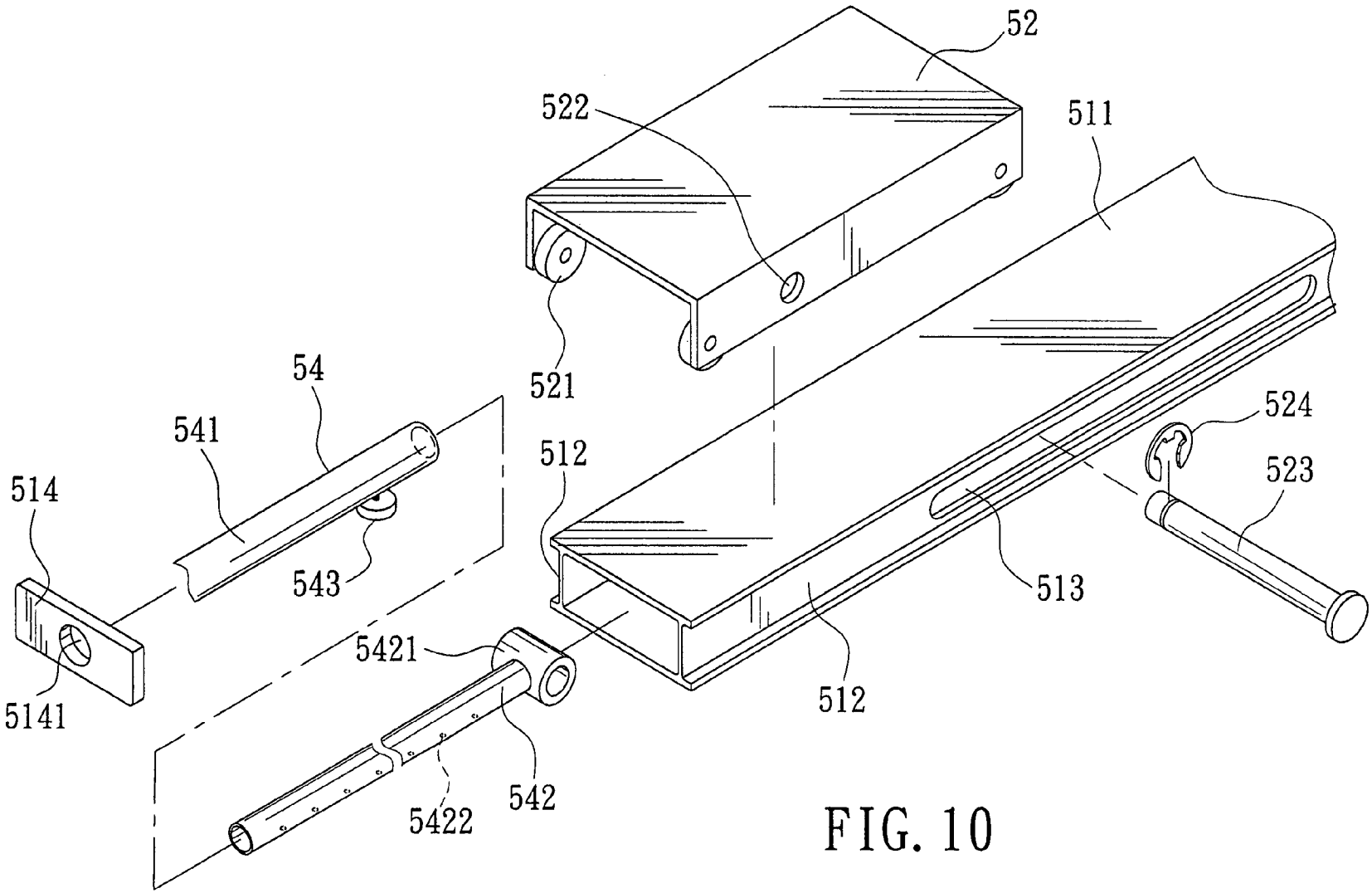
FIG. 10 is an exploded perspective view of a link mechanism, a rear frame, and a slide seat of the preferred embodiment.
Figure 11:
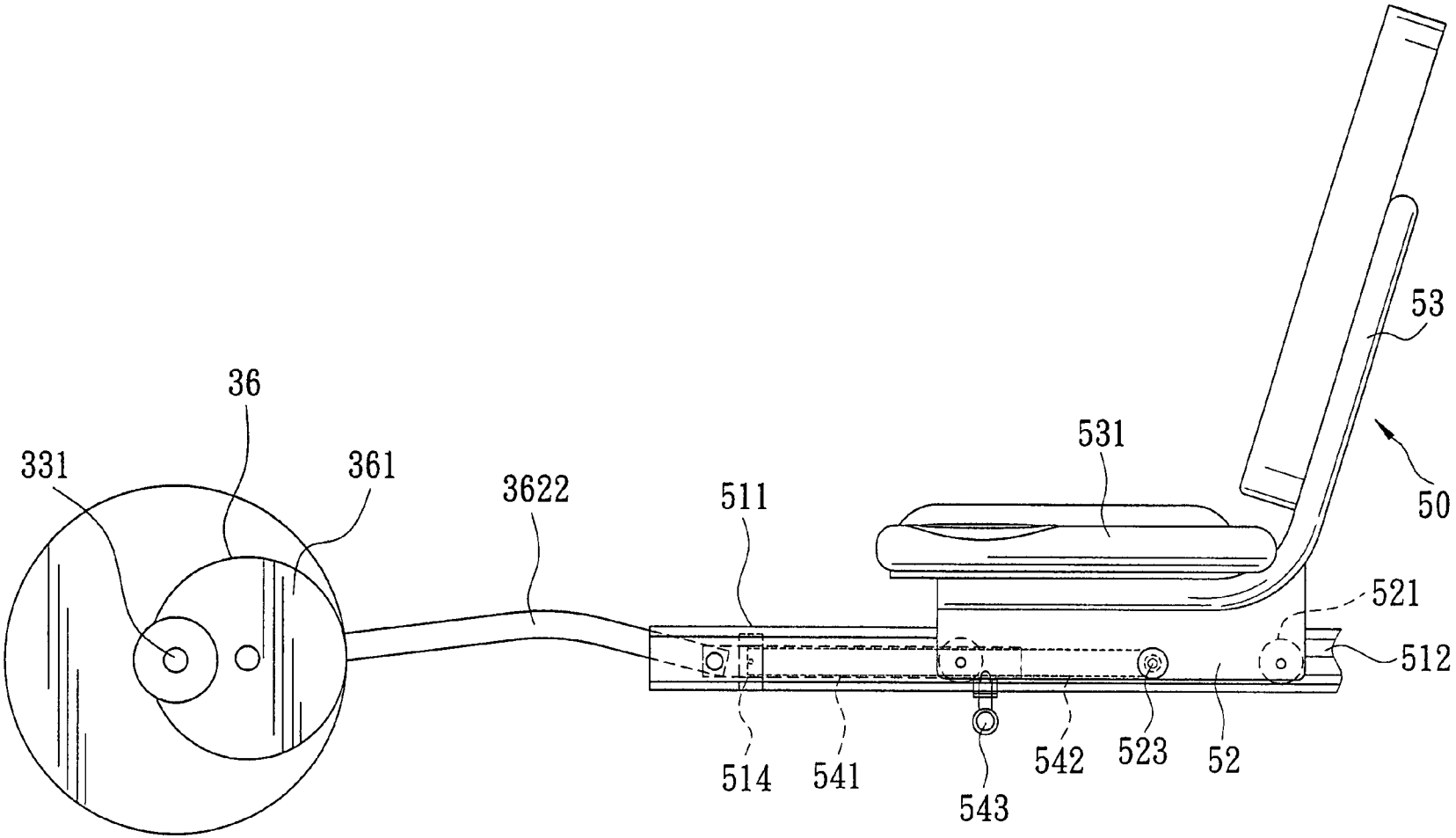
FIG. 11 illustrates how the drive wheel, the crank wheel, the link mechanism, the rear frame, and the slide seat are interconnected.

With reference to FIGS. 4, 10, and 11, the chair assembly 50 includes a slide seat 52, a chair 53, and a link mechanism 54. The slide seat 52 is mounted slidably on the support bar 511, and has two opposite lateral sides provided respectively with a plurality of rollers 521 engaged slidably to the respective slide rails 512, so that the slide seat 52 can move forwardly and rearwardly along the slide rails 512. Each lateral side of the slide seat 52 is formed with a fastening hole 522. The chair 53 is supported fixedly on the slide seat 52, and has two horizontal secondary handgrips 531 (only one is visible in FIGS. 4 and 11) provided respectively on two opposite lateral sides thereof.

The link mechanism 54 includes a first link rod 3622 having a front end welded to one side of the ring 362, a telescopic second link rod connected pivotally to the first link rod 3622, and a limiting member 514 inserted into the support bar 511 at a front end portion thereof and having a central hole 5141. The second link rod includes an outer tube 541, and an inner tube 542 connected telescopically to the outer tube 541. The outer tube 541 extends into the support bar 511 via the central hole 5141, and has a front end connected pivotally to a rear end of the first link rod 3622. The inner tube 542 has a substantially T-shaped configuration, and has a hollow head section 5421, and a plurality of positioning holes 5422 spaced apart from each other along the length of the inner tube 542.

A fixing pin 523 extends through one of the fastening holes 522, one of the elongated slots 513, the head section 5421 of the inner tube 542, the other one of the fastening holes 522, and the other one of the elongated slots 513. A C-shaped retaining ring 524 is engaged to the fixing pin 523 so as to fix slidably the slide seat 52 to the slide rails 512 and so as to restrict movement of the slide seat 52 along the elongated slot 513. A knob 543 has a threaded portion extending through a bottom face of the support bar 511 so as to connect threadedly the outer tube 541 and engage selectively one of the positioning holes 5422, thereby fixing the inner tube 542 to the outer tube 541. When the knob 543 is loosened, the inner tube 542 is slidable relative to the outer tube 541, the entire length of the link mechanism 54 can be prolonged or shortened, and the positioning of the slide seat 52 on the slide rails 512 can be controlled. This facilitates adjustment of the chair 53 according to the height of the user. When the link mechanism 54 is driven by the crank wheel 36 to move therealong, the slide seat 52 and the chair 53 also move so that the user performs a reciprocal forward and rearward exercise.

Figure 12:
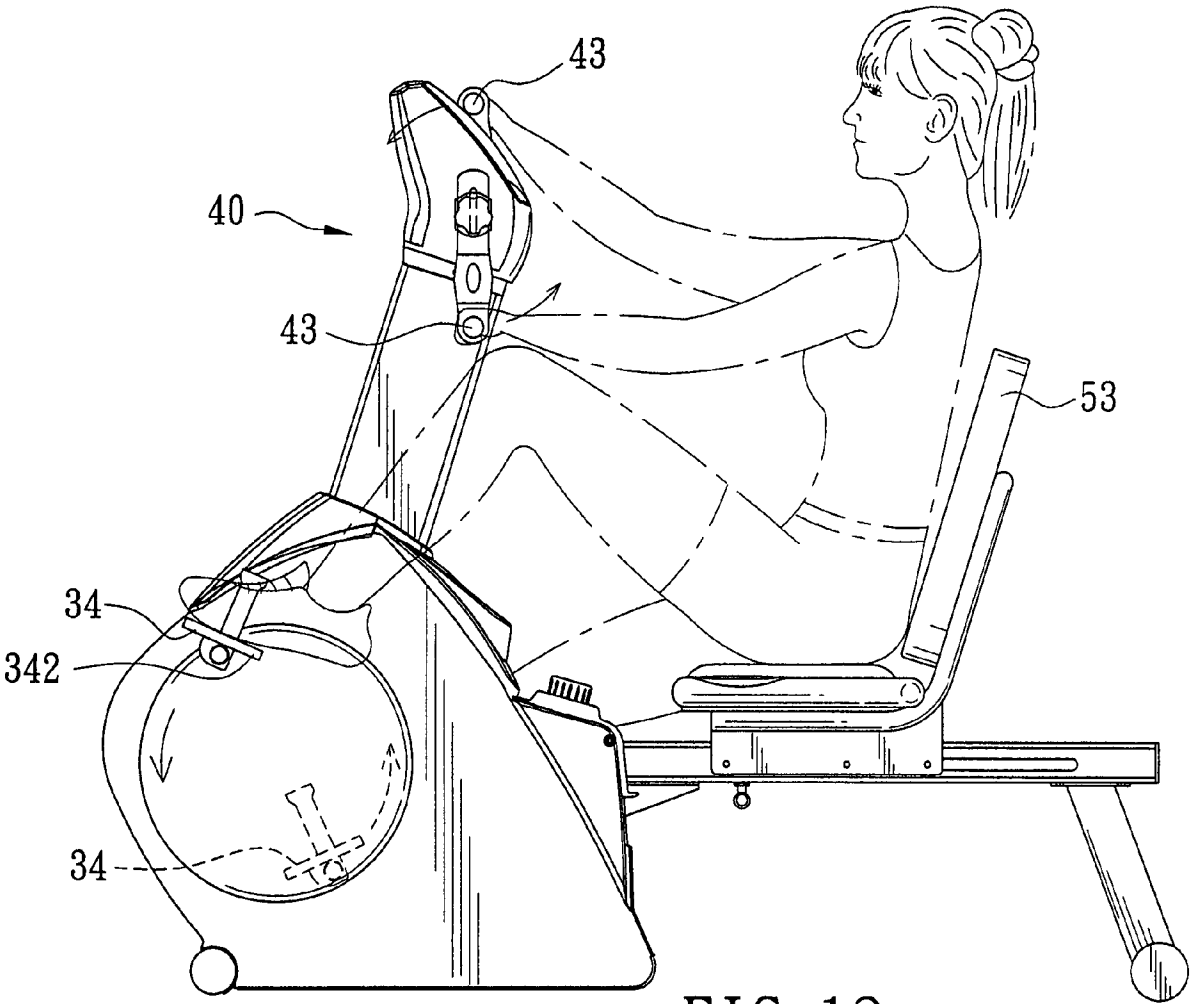
FIG. 12 illustrates one use of the exercising device of the present invention.

FIG. 12 illustrates an exercise performed using the exercising device of the present invention. The user sits on the chair 53 with both feet stepping on the respective pedal plates 342 of the pedal units 34 and with both hands grasping the respective handgrips 43. In this exercise, the handgrips 43 are spaced apart from each other at an angular distance of 180°, and the pedal plates 342 are also spaced apart from each other at an angular distance of 180°. Hence, the user's feet are used to perform a pedaling action, while the user's hands are used to perform a hand-cycling exercise, such that the user's upper body and legs are exercised.

Figure 13:
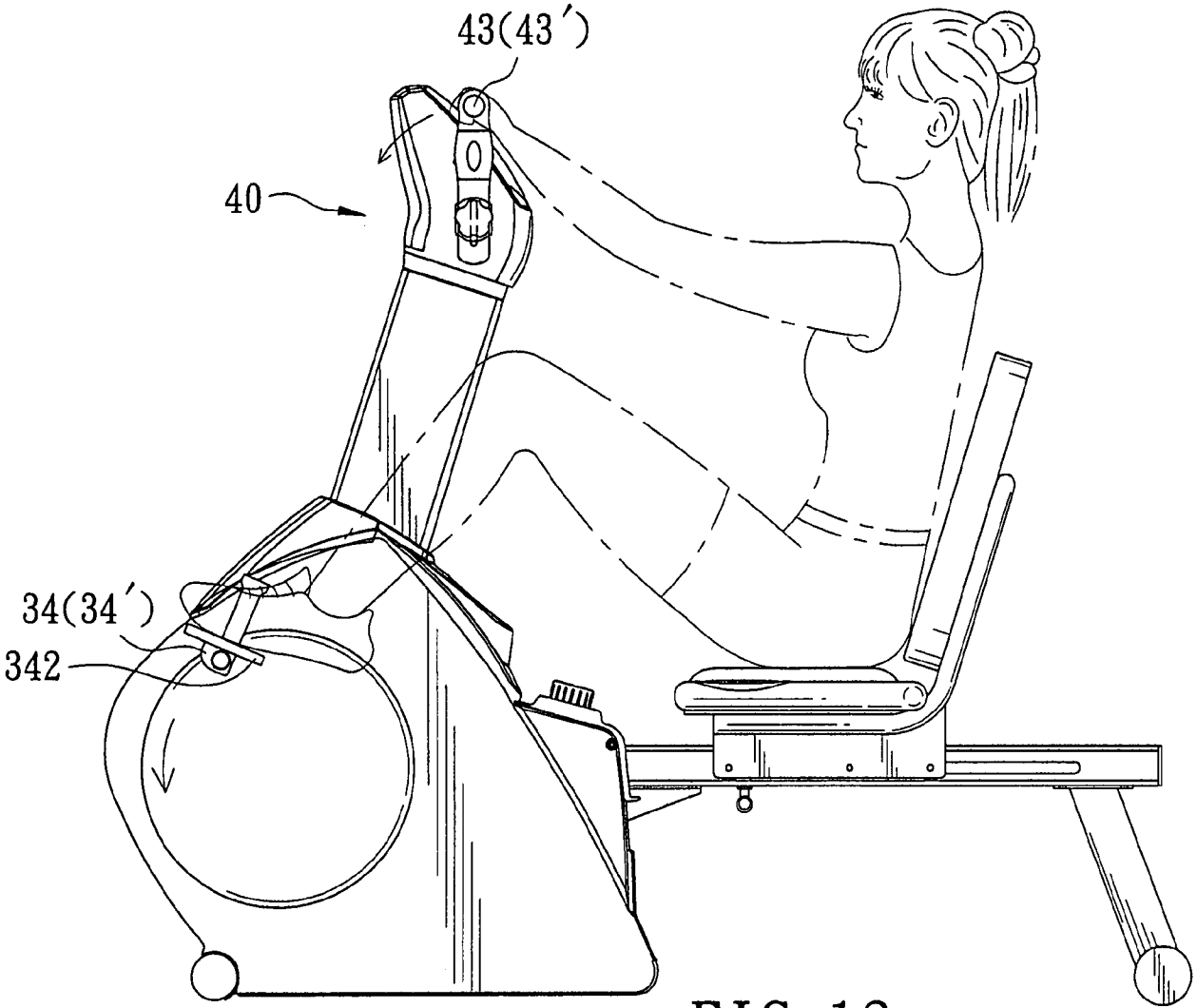
FIG. 13 illustrates another use of the exercising device of the present invention.

FIG. 13 illustrates another exercise performed using the exercising device of the present invention. In this exercise, the pedal unit 34 is adjusted so as to position the pedal plate 342 at the same angular position as the other pedal plate 342' (see FIG. 6), and one of the handgrips 43 is also adjusted so as to be at the same angular position as the other hand grip 43'. The pedal units 34, 34' are pedaled by the user's feet to rotate in the same direction, and the handgrips 43, 43' are also pushed by the user's hands to rotate in the same direction. The upper body and leg muscles of the user are exercised through such a use of the exercising device.

Figure 14:
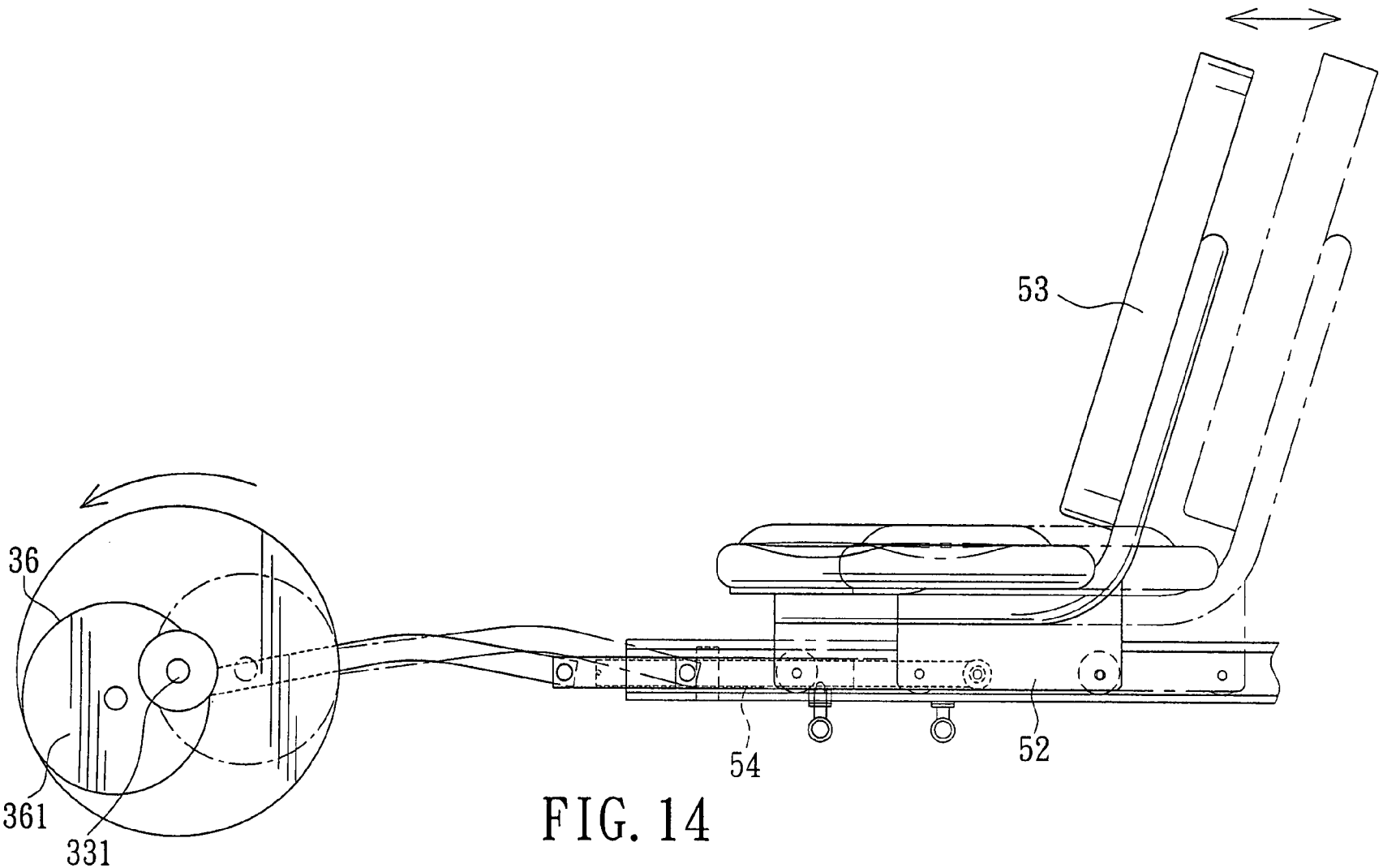
FIG. 14 illustrates how the link mechanism is driven by the crank wheel so as to move forward and rearward the slide seat.
Figure 15:
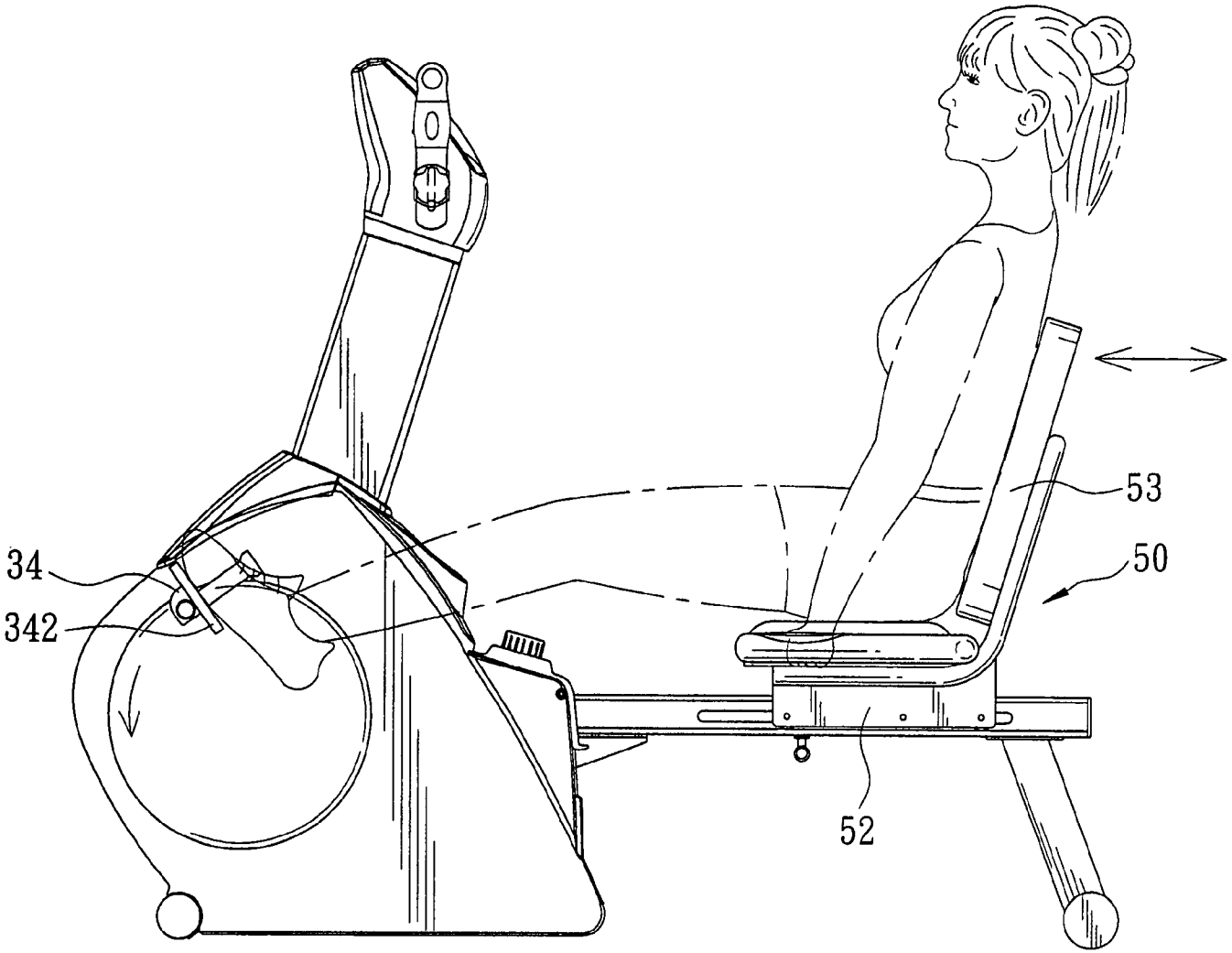
FIG. 15 illustrates a still another use of the exercising device of the present invention.

FIGS. 14 and 15 are used to describe still another exercise performed using the exercising device of the present invention. In this exercise, the user's hands grasp respectively the secondary handgrips 531, and the user's feet step respectively on the pedal plates 342, 342' (see FIG. 6) of the pedal units 34, 34' (see FIG. 6). Since the slide seat 52 is connected to the link mechanism 54 and the crank wheel 36, and since the disc 361 of the crank wheel 36 is co-rotatable with the drive wheel 33, when the user's feet start a pedaling action, the slide seat 52 together with the chair 53 is brought to move forwardly and rearwardly along the slide rails 512. The user's legs and abdomen are exercised through such a use of the exercising device.

From the aforementioned description, it is apparent that the exercising device of the present invention can resolve the aforementioned drawbacks of the conventional exercising devices 10 and 20. The present invention provides adjustment to the angular positions of the pedal units 34, 34' and the handgrips 43, 43' of the handle assembly 40, so that the user can adjust the pedal units 34, 34' and the handgrips 43, 43' according to his/her exercise requirements. The pedal units 34, 34' and/or the handgrips 43, 43' may be adjusted so that the pedal plates 342, 342' and/or the handgrips 43, 43' can be spaced apart from each other at an angular distance of 180° or can be at the same angular position. Further, movement of the chair assembly 50 in cooperation with the different exercises performed using the pedal units 34, 34' and the handle assembly 40 allows for further training of the user's body.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An exercising device comprising:

a front frame;

a resistance flywheel mounted rotatably on said front frame;

a drive wheel connected drivingly to said resistance flywheel;

a crank wheel;

a shaft connected rotatably to said front frame and extending centrally through said drive wheel and eccentrically through said crank wheel for co-rotating said drive wheel and said crank wheel;

two pedal units connected respectively to left and right ends of said shaft;

a handle assembly mounted on top of said front frame;

a rear frame extending rearwardly from said front frame;

a slide seat mounted slidably on said rear frame;

a chair supported on said slide seat; and a link mechanism connected to and disposed between said slide seat and said crank wheel, said link mechanism being driven by said crank wheel so as to move forward and rearward said slide seat.

2. The exercising device of claim 1, wherein said crank wheel includes a disc having an eccentric hole connecting said shaft, and a ring, said disc and said ring being sleeved one around the other, said ring being rotatable relative to said disc and connected to said link mechanism.

3. The exercising device of claim 2, wherein said link mechanism includes a first link rod connected to one side of said ring, and a telescopic second link rod connected pivotally to said first link rod.

4. The exercising device of claim 1, wherein each of said pedal units has a pedal crank journalled to said shaft, and a pedal plate fixed to an end of said pedal crank, at least one of said pedal cranks of said pedal units being rotatable relative to said shaft to adjust in angular position relative to said shaft, at least one of said pedal units further having a tightening member to prevent said one of said pedal cranks from rotation relative to said shaft.

5. An exercising device comprising:

a front frame;

a resistance flywheel mounted rotatably on said front frame;

a drive wheel connected drivingly to said resistance flywheel and having a shaft;

two pedal units connected respectively to left and right ends of said shaft;

a crank wheel co-rotatable with said drive wheel about an axis of rotation;

a handle assembly mounted on top of said front frame and including a support rod extending upwardly from said front frame, a spindle connected to and projecting from left and right sides of said support rod, and two handgrips connected respectively to two opposite ends of said spindle, at least one of said handgrips being releasably connected to said spindle for adjusting an angular position of said one of said handgrips relative to said spindle, said handle assembly further including at least one handgrip positioning unit that connects adjustably and releasably said one of said handgrips to said spindle;

a rear frame extending rearwardly from said front frame;

a slide seat mounted slidably on said rear frame; and a link mechanism connected to and disposed between said slide seat and said crank wheel, said link mechanism being driven by said crank wheel so as to move forward and rearward said slide seat.

6. The exercising device of claim 5, wherein said handgrip positioning unit includes a handgrip positioning plate that has a proximal end portion substantially perpendicular and connected to said spindle, and a distal end portion connected to said one of said handgrips and radially offset from said spindle, a limit member that is disposed between said spindle and said proximal end portion to limit rotation of said proximal end portion, and a tightening member connected to said spindle to press said proximal end portion against said limit member when said tightening member is tightened.

7. The exercising device of claim 6, wherein said limit member has a substantially U-shaped plate defining a channel that receives said proximal end portion.

8. The exercising device of claim 7, wherein said tightening member has a threaded portion extending through said proximal end portion and said limit member and threaded into said spindle, a knob, and a press part connected between said threaded portion and said knob to press said proximal end portion against said limit member and said spindle when said tightening member is tightened.

9. The exercising device of claim 8, wherein said proximal end portion has an elongated slot for extension of said threaded portion therethrough, said tightening member being movable relative to said elongated slot for adjustment of a radial distance between said one of said handgrips and said spindle.

10. The exercising device of claim 5, wherein said one of said handgrips is adjusted to be at the same angular position as the other one of said handgrips.

* * * * *